United States Patent [19]

Lewis

[11] 4,452,237

[45] Jun. 5, 1984

[54] SELF ACUPRESSURE APPARATUS

[76] Inventor: Tommy K. Lewis, 1605 Henry St., Huntington, Ind. 46750

[21] Appl. No.: 317,991

[22] Filed: Nov. 4, 1981

[51] Int. Cl.[3] ..... A61H 39/04

[52] U.S. Cl. ..... 128/60; 128/303 R; 128/329 A

[58] Field of Search ..... 128/60, 61, 67, 329 A, 128/303 R; 248/284, 286, 454, 460; 403/61

[56] References Cited

U.S. PATENT DOCUMENTS

| | | | |
|---|---|---|---|
| 3,109,177 | 11/1963 | Grafmyer . | |
| 3,380,595 | 4/1968 | Klausen . | |
| 3,504,878 | 4/1970 | Dressler . | |
| 3,669,118 | 6/1972 | Colon-Morales | 248/286 X |
| 3,730,469 | 5/1973 | Shields . | |
| 3,831,592 | 8/1974 | Lancellotti | 128/60 |
| 4,033,054 | 7/1977 | Fukuoka . | |
| 4,037,590 | 7/1977 | Dohring . | |
| 4,260,124 | 4/1981 | Heilman | 248/460 X |

*Primary Examiner*—Michael H. Thaler
*Attorney, Agent, or Firm*—Jeffers, Irish & Hoffman

[57] ABSTRACT

The apparatus of the present invention is used to administer therapeutic acupressure to various points or areas of the body in order to temporarily relieve certain body ailments. The apparatus comprises a plate vertically mounted on a wall structure, an arm having one end rotatably connected to an upper portion of the plate, the arm and the plate being in juxtaposed relation, a bar secured to the opposite end of the arm and extending outwardly therefrom, and a knob member removably attached to the remote free end of the bar. The method of using the apparatus of the present invention includes providing an appropriate size knob member to the free end of the bar, adjusting the arm to position the knob member at the height of the body area to be treated, placing the body area in contact with the knob member, and then applying pressure intermittently to the body area in contact with the knob member.

9 Claims, 6 Drawing Figures

SELF ACUPRESSURE APPARATUS

BACKGROUND OF THE INVENTION

This invention pertains to a therapeutic apparatus, and more particularly to a self acupressure apparatus wherein pressure may be applied to various areas of the body in order to provide temporary relief of certain ailments.

The apparatus of the present invention has been found to be highly beneficial in providing temporary alleviation of certain body ailments which are not responsive to medication. Some examples of ailments which do not respond to medication, but have been found to respond to pressure therapy are arthritis, bursitis, migraine headaches, tennis elbow, osteomalacia and the like.

The art of acupressure is similar to the art of acupuncture except that no needles are used in applying the acupressure treatment. Specifically, acupressure is the application of pressure to various body areas to effect nerve junctures within the body. The nerve junctures affected in order to provide temporary relief of the above ailments are generally associated with the sciatic nerve, which is a sensor and motor nerve originating in the sacral plexus and running through the pelvis and upper leg. The relief brought about by the application of acupressure to these nerve junctures is probably the result of either the temporary deadening of the nerve junctures or a redistribution of the blood supply.

An example of earlier application of acupressure is found in U.S. Pat. No. 4,037,590 issued on July 26, 1977. The device of this patent has several disadvantages, the first of which is its use of electricity in providing therapy, and the resulting requirement that the device be made of electrically conductive materials. Such use of electricity naturally carries the risk of subjecting the body to serious shock. A second disadvantage of the subject device is the small diameter of the pressure member and the inability to replace the pressure member with members of larger diameter. A third and most significant problem with the device of this invention is that it is hand held and consequently requires an additional person to administer the therapeutic pressure on certain areas of the body, for example, the upper and lower back areas. Certainly, when relief is required, it is highly desirable that the relief may be administered by the user of the device.

SUMMARY OF THE INVENTION

The apparatus of the present invention overcomes the advantages above in an economical and unique fashion. Specifically, the apparatus of the present invention does not require the utilization of electricity in administering acupressure therapy thereby totally eliminating any possibility of the user being subjected to serious shock. Additionally, no special electrically conductive materials are required in its construction.

Another advantage of the present invention is that it is not limited to a single small pressure point for administering the therapeutic pressure to the body area. The invention provides for pressure points, hereinafter referred to as knob members, which are of varying size, are replaceable, and are interchangeable one with another. This versatility of the apparatus of the invention allows it to administer pressure to the particular body area in a more therapeutically desirable manner.

One of the most desirable features of the present apparatus, in contrast to the apparatus of the prior art, is that the user may operate the apparatus to apply therapeutic pressure to any part of area of the body without the requirement of an additional person to aid in the administration of the pressure therapy. This feature of the apparatus is particularly valuable to the elderly who generally experience the type of ailments which the present invention alleviates, and who generally reside by themselves.

Broadly stated, the invention provides an apparatus for administering therapeutic pressure to various points or areas of the body in order to temporarily relieve certain ailments and pain. The apparatus comprises a plate vertically mounted on a wall structure, an arm having one end rotatably connected to an upper portion of the plate thereby placing the plate and the arm in a juxtaposed relation, a bar secured to the opposite end of the arm and extending outwardly therefrom, and a knob member removably attached to the remote free end of the bar, whereby the arm may be rotated about the plate so as to position the bar and the knob member at the desired height for the administration of the therapeutic pressure. The method of using the apparatus comprises providing an appropriate size knob member to the free end of the bar, adjusting the arm to position the knob member at the height of the body area to be treated directing the body area near the knob member, placing the body area in contact with the knob member, and then applying pressure to the body area in contact with the knob member.

It is therefore an object of the present invention to provide an apparatus for applying acupressure therapy to different points or areas of the body.

Another object of the present invention is to provide an acupressure apparatus which does not utilize electricity in the administration of therapeutic pressure, thereby eliminating any risk of serious shock, and electrically conductive materials in its construction.

Still another object of the present invention is to provide various size knob members in applying pressure to different points or areas of the body.

A further object of the present invention is to provide an acupressure apparatus which may be operated solely by the user without the requirement of an additional person to aid in the administration of the therapeutic pressure.

A still further object of the present invention is to provide an acupressure apparatus which is economical to manufacture and easy to install.

BRIEF DESCRIPTION OF THE DRAWINGS

The above-mentioned and other features and objects of this invention, and the manner of attaining them will become more apparent and the invention itself will be better understood by reference to the following description of an embodiment of the invention taken in conjunction with the accompanying drawings, wherein.

DESCRIPTION OF A PREFERRED EMBODIMENT

Figure 1:
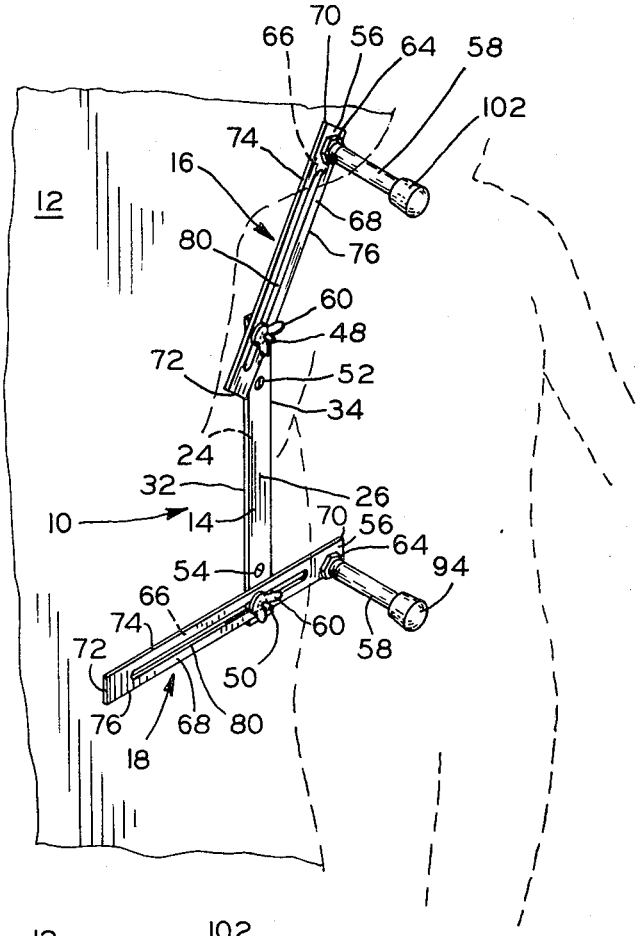
FIG. 1 is a front perspective view of a preferred embodiment of the invention illustrating its position in relation to a user.

Referring to the figures, the acupressure apparatus 10 of the present invention is depicted as mounted on a structure 12, such as a wall or door. Apparatus 10 comprises in major part plate 14, top arm assembly 16, bottom arm assembly 18, knob 20, and knob 22.

Plate 14 is generally rectangular in shape and has a back surface 24, front surface 26, top surface 28, bottom surface 30, and sides 32, 34. The upper portion 36 of plate 14 has an aperture 38 therein passing through front surface 26 to back surface 24, and an aperture 40 likewise disposed therein. Plate 14 also has a lower portion 42, which has an aperture 44 passing through front surface 26 to back surface 24 and aperture 46 likewise disposed therethrough. Prior to mounting plate 14 to structure 12, a flat head blot 48 is received through aperture 38 from back surface 24 so that the threaded portion of bolt 48 extends beyond front surface 26 of plate 14, and a flat head bolt 50 is likewise received through aperture 44. Plate 14 is generally mounted vertically to wall 12 by flat head screws 52, 54 through holes 40, 46, respectively, in plate 14.

Top arm assembly 16 includes in major part arm 56, bar 58, wingnut 60, and locknuts 62, 64. Arm 56 of top arm assembly 16 is generally rectangularly shaped and has a backside 66, front side 68, top side 70, bottom side 72, left side 74, and a right side 76. Also provided in arm 56 is an opening 78 near top side 70 and which passes through front side 68 to back side 66, and a slot 80 likewise disposed longitudinally therethrough. Arm 56 is attached to plate 14 by passing the extended portion of bolt 48 through slot 80 of arm 56, and secured thereto by passing a washer 82 over and threadedly engaging a wingnut to the extended end portion of bolt 48. As just described, arm 56 is rotatably and slidably adjustable on plate 14 by loosening wingnut 60 and rotating or sliding arm 56 about bolt 48 through slot 80. Parenthetically, the width of slot 80 is greater than the diameter of bolt 48 in order to allow the aforementioned rotating and sliding actions.

Figure 3:
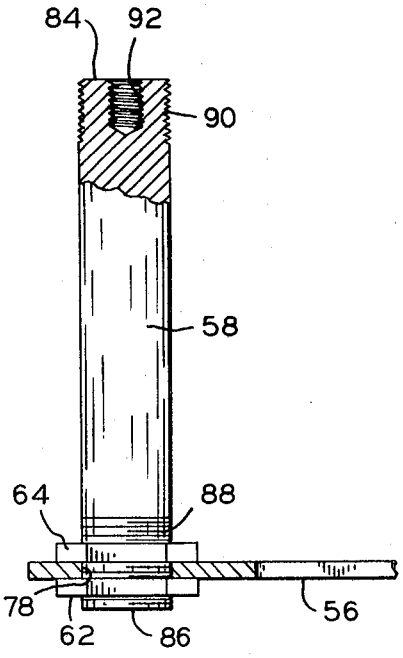
FIG. 3 is a partially cutaway side view depicting a bar and an arm of an embodiment of the present invention.
Figure 6:
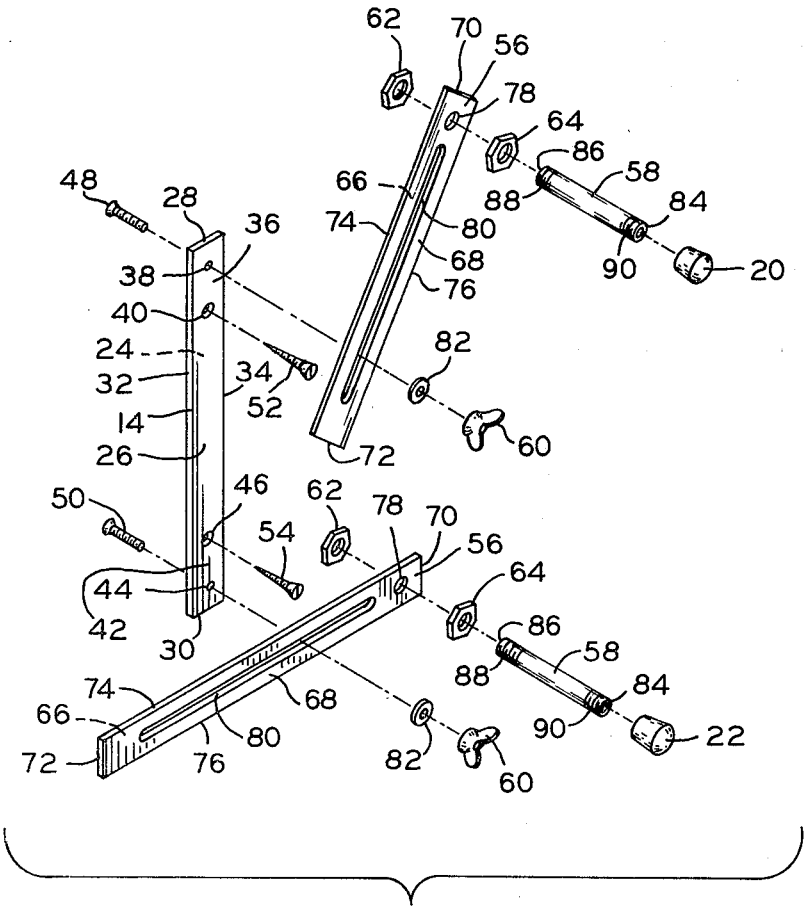
FIG. 6 is an exploded view of an embodiment of the present invention.

Viewing FIGS. 3 and 6, it may be seen that bar 58 is generally cylindrical in shape and has ends 84, 86. The diameter of bar 58 is less than the diameter of opening 78 in arm 56 so that end 86 of bar 58 may be received through the opening 78. The lower portion of bar 58 near end 86 has an external thread 88 thereon upon which a lock nut 64 is threadedly engaged. End 86 of bar 58 is then passed through opening 78 and secured to arm 56 by a second lock nut 62 threadedly engaged thereon. In attaching bar 58 to arm 56, it is preferred that end 86 not extend through lock nut 62, but that locknut 62 be threadedly positioned on end 86 so as to present a flush surface. Also, the thickness of locknut 62 should be the same as the thickness of plate 14 between back surface 24 and front surface 26, thereby preventing the application of any bending moment on arm 56 at its attachment to plate 14 during the application of therapeutic pressure. The opposite end 84 of bar 58 likewise has an external thread 90 thereon and, additionally, has an internal thread 92 tapped concentrically therein.

Figure 4:
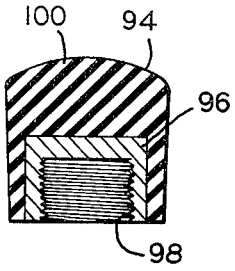
FIG. 4 is a cross-sectional view of one knob member of an embodiment of the present invention.

Removably attached to end 84 of bar 58 is knob 20. In describing knob 20, reference will be made to FIG. 4 which illustrates a larger knob 94. Both knob 20 and knob 94 are identical except for the larger size of knob 94. Referring now to FIG. 4, knob 94, and knob 20, has a core 96 made of a hard material such as steel or the like. Core 96 further has a knob opening 98 threadedly tapped therein, and is surrounded by a cover 100. Cover 100 may be made of any type material, for example, steel, aluminum, foam, rubber of the like. Generally, it is desired that cover 100 be made of a resilient material such as rubber in order to not bruise the body area being administered. Knob 94 as mentioned earlier is larger than knob 20 and may be made so by enlarging cover 100 or having both an enlarged cover 100 and core 96. Thusly described, knob 20 is then threadedly engaged about end 84 of bar 58 to provide means for applying the therapeutic pressure to the particular body area.

Figure 5:
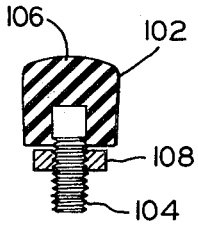
FIG. 5 is a cross-sectional side view of a smaller knob member of an embodiment of the present invention.

As earlier mentioned above, the apparatus 10 may utilize knobs of varying size such as knob 20, knob 94, and knob 102 in FIG. 5. Knob 102 illustrates the smaller type knob usable with the acupressure apparatus 10. Knob 102 comprises a bolt 104 having one end embedded in a cover 106. Again, cover 106 may be made of any material, but it is preferred that the material be rubber. Threadedly engaged about bolt 104 is a locknut 108, which is utilized to protect cover 106 upon tightening knob 102 to end 84 of bar 58. The attachment of knob 102 to bar 58 is accomplished by threadedly engaging bolt 104 of knob 102 with the internal thread 92 of bar 58.

Bottom assembly 18 is identical to top assembly 16 and therefore will not be described herein. Like elements between the two assemblies 16, 18 have been given identical reference numerals and are assembled in the same manner as described above.

Figure 2:
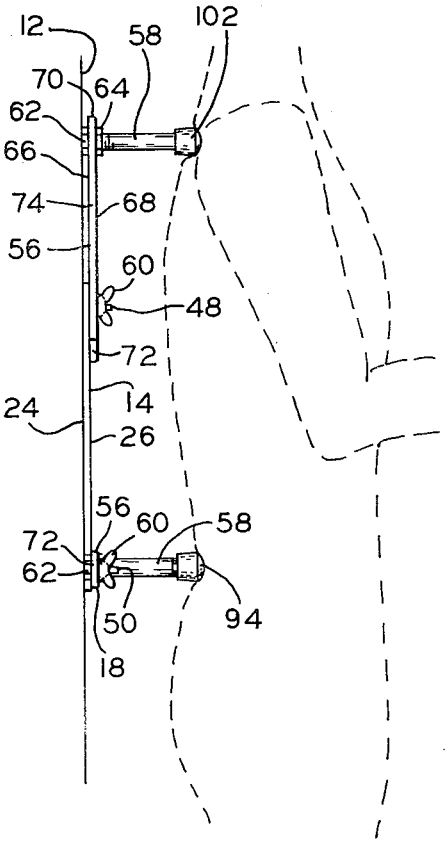
FIG. 2 is a side view of FIG. 1.

The operation of acupressure apparatus 10 is illustrated in FIGS. 1 and 2. An example of the use of apparatus 10 will be illustrated by using both top and bottom arm assemblies 16, 18, however, it should be noted that the assemblies 16, 18 may be operated either individually or collectively. FIGS. 1 and 2 illustrate the body of a user requiring the administration of therapeutic pressure to the lower neck area and the lower back area. In preparation, the user will initially choose the appropriate size knob to fit the area to be treated. In this example, smaller knob 102 would be used with top assembly 16 and larger knob 94 would be used with bottom assembly 18. Arms 56 are positioned by loosening wing nuts 60 to allow arms 56 to be rotated and slid about its respective bolt 48, 50. Upon rotating and sliding arms 56 to place smaller knob 102 and larger knob 94 at the correct position in relation to the body, wing nuts 60 are then tightened in order to maintain arms 56 in the correct position. The user then directs and places the appropriate body areas in contact with the particular knob 102, 94. The administration of the therapeutic pressure is then applied by pressing the body area against the respective knob 102, 94 for approximately five to ten seconds, and then withdrawing the body area from the particularly knob 102, 94 in order to release the pressure while being careful to maintain body contact with the knobs 102, 94. A repetition of the application of pressure is generally required in order to provide a sufficient amount of therapy to alleviate the ailment. As can be seen from FIGS. 1 and 2, top arm assembly 16 is easily adaptable to provide therapy for the upper back, neck, and shoulders, while bottom arm assembly 18 is more suited for applying therapy to the back, lower back, and the upper legs. Although pressure can be applied to two areas simultaneously, often only one arm at a time will be used.

While this invention has been described as having a specific embodiment, it will be understood that it is capable of further modifications. This application is therefore intended to cover any variations, uses, or adaptations of the invention following the general principles thereof and including such departures from the present disclosure as come within known or customary practice in the art to which this invention pertains and fall within the limits of the appended claims.

What is claimed is:

1. An apparatus mounted generally vertically on a structure for self-administering therapeutic pressure to various points or areas of the body in order to temporarily relieve certain ailments, comprising:

a plate vertically mounted on said structure, an arm having one end rotatably connected to said plate, said arm and said plate being in juxtaposed relation and said arm being rotatably moveable in a generally vertical plane parallel to said plate, said arm having a slot longitudinally disposed therein, said arm being rotatably and slidably connected through said slot to said plate, a first bar secured to the opposite end of said arm and having a remote free end extending outwardly from said arm in a direction generally normal to said plane and said plate, and a knob member removably attached to the remote free end of said bar, whereby said arm may be rotated about said plate so as to position said bar and said knob at the desired height and position for administration of selectively variable therapeutic pressure by the user, said knob member being removable and replaceable by other individual knob members of varying sizes in order to optimally accommodate the various points or areas of the body to which therapeutic pressure is to be administered.

2. The apparatus of claim 1 including:

a second arm having a slot longitudinally disposed therein, said second arm being rotatably and slidably connected through said slot to a lower portion of said plate, said second arm and said plate being in juxtaposed relation and said second arm being rotatably and slidably movable in a generally vertical plane parallel to said plate, a second bar secured to an end of said second arm and having a remote free end extending outwardly from said second arm in a direction generally normal to said plane and said plate, and a second knob member removably attached to the remote free end of said second bar, whereby said arm and said second arm may be rotatably and slidably positioned on said plate upper and lower portions, respectively, so as to place said first bar and said knob member, and said second bar and said second knob member, respectively, at selected widely spaced-apart areas of the body for administration of therapeutic pressure.

3. The apparatus of claim 2 wherein said second knob member is removable and replaceable by other individual knob members of varying sizes in order to optimally accommodate the different points or areas of the body to which therapeutic pressure is to be administered.

4. An apparatus generally mounted vertically on a structure for self-administering therapeutic pressure to various points or areas of the body in order to temporarily relieve certain ailments, comprising:

a plate vertically mounted on said structure, an arm having one end rotatably connected to an upper portion of said plate, said arm and said plate being in juxtaposed relation and said arm being rotatably movable in a generally vertical plane parallel to said plate, a first bar secured to the opposite end of said arm and having a remote free end extending outwardly from said arm in a direction generally normal to said plane and said plate, a knob member removably attached to the remote free end of said bar, whereby said arm may be rotated about said plate upper portion so as to position said bar and said knob at the desired height and position for administration of selectively variable therapeutic pressure by the user, a second arm having one end rotatably connected to a lower portion of said plate, said second arm and said plate being in a juxtaposed relation and said second arm being rotatably movable in a generally vertical plane parallel to said plate, a second bar secured to the opposite end of said second arm and having a remote free end extending outwardly from said second arm in a direction generally normal to said plane and said plate, and a second knob member removably attached to the remote free end of said second bar, whereby said second arm may be rotated about said plate lower portion so as to position said second bar and said second knob member at the desired height and position for administration of therapeutic pressure.

5. The apparatus of claim 4 wherein said second arm has a slot longitudinally disposed therein, said second arm being rotatably and slidably connected through said slot to said plate lower portion.

6. A self-administering apparatus for providing an alleviative for stiff and aching spaced-apart areas of the body comprising:

a plate, a first arm having one end rotatably and slidably connected to an upper portion of said plate, said first arm and said plate being in juxtaposed relation, a second arm having one end rotatably and slidably connected to a lower portion of said plate, said second arm and said plate being in juxtaposed relation, said first and said second arms being rotatably and slidable in a plane substantially parallel to said plate, a first bar secured to the opposite end of said first arm and having a remote free end extending outwardly therefrom in a direction generally normal to said plane and said plate, a second bar secured to the opposite end of said second arm and having a remote free end extending outwardly therefrom in a direction generally normal to said plane and said plate, a first knob member removably attached to said remote free end of said first bar, and a second knob member removably attached to said remote free end of said second bar, whereby said first and second arms may be rotated and slid relative to said plate in order to position said first and second bars and said first and second knob member, respectively, at selected widely spaced-apart areas of the body to be alleviated.

7. The apparatus of claim 6 further including other individual knob members of differing sizes, said other knob members being replaceable and interchangeable with said knobs on said first and second bars.

8. The apparatus of claim 7 wherein said first and second arms each have a slot longitudinally disposed therein, said first and second arms being rotatably and slidably connected through said slots, respectively, to said plate.

9. An apparatus generally mounted vertically on a structure for self-administering therapeutic pressure to various points or areas of the body in order to temporarily relieve certain ailments, comprising:

a plate vertically mounted on said structure, an arm having one end rotatably connected to said plate, said arm and said plate being in juxtaposed relation and said arm being rotatably movable in a generally vertical plane parallel to said plate, said arm having a slot longitudinally disposed therein, said arm being rotatably and slidably connected through said slot to said plate, a first bar secured to the opposite end of said arm and having a remote free end extending outwardly from said arm in a direction generally normal to said plane and said plate, and a knob member attached to the remote free end of said bar, whereby said arm may be rotated about said plate so as to position said bar and said knob at the desired height and position for administration of selectively variable therapeutic pressure by the user.

* * * * *